US009109783B1

(12) United States Patent
Davis et al.

(10) Patent No.: US 9,109,783 B1
(45) Date of Patent: Aug. 18, 2015

(54) SECONDARY ENCLOSURE FOR LIGHT-EMITTING DIODE-BASED LIGHTING SYSTEM

(71) Applicants: Jared Davis, Newnan, GA (US); Kevin Roy Harpenau, Peachtree City, GA (US); Jyoti Kathawate, Smyrna, GA (US); Russell Bryant Green, Douglasville, GA (US); Gregg A. Lehman, Peachtree City, GA (US)

(72) Inventors: Jared Davis, Newnan, GA (US); Kevin Roy Harpenau, Peachtree City, GA (US); Jyoti Kathawate, Smyrna, GA (US); Russell Bryant Green, Douglasville, GA (US); Gregg A. Lehman, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 159 days.

(21) Appl. No.: 13/746,817

(22) Filed: Jan. 22, 2013

Related U.S. Application Data

(60) Provisional application No. 61/588,537, filed on Jan. 19, 2012.

(51) Int. Cl.
*F21V 23/00* (2015.01)

(52) U.S. Cl.
CPC ..... *F21V 23/001* (2013.01)

(58) Field of Classification Search
USPC ..... 362/364, 365, 647, 651, 652, 368
See application file for complete search history.

(56) References Cited

U.S. PATENT DOCUMENTS

| | | | | |
|---|---|---|---|---|
| 4,055,874 | A | 11/1977 | Brown | |
| 4,332,060 | A | 6/1982 | Sato | |
| 5,584,575 | A | 12/1996 | Fickel | |
| 5,619,789 | A | 4/1997 | Chung | |
| 5,673,997 | A | 10/1997 | Akiyama | |
| 5,738,436 | A | 4/1998 | Cummings et al. | |
| 5,951,151 | A | 9/1999 | Doubeck et al. | |
| 6,305,829 | B1 * | 10/2001 | Thomas et al. | 362/519 |
| 6,979,107 | B1 | 12/2005 | Benensohn | |
| 7,018,070 | B2 | 3/2006 | McCoy | |
| 7,120,969 | B2 | 10/2006 | Carls | |
| 7,438,433 | B1 * | 10/2008 | Steadman et al. | 362/147 |
| 7,487,584 | B1 | 2/2009 | Lee | |
| 7,959,332 | B2 | 6/2011 | Tickner et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 | 7/2012 | Khazi et al. | |
| 8,348,477 | B2 | 1/2013 | Tickner et al. | |
| 8,405,947 | B1 | 3/2013 | Green et al. | |
| 8,445,144 | B2 * | 5/2013 | Utsugi et al. | 429/340 |
| 8,491,166 | B2 | 7/2013 | Thompson, III | |
| 8,500,305 | B2 * | 8/2013 | O'Sullivan et al. | 362/294 |
| 8,602,601 | B2 | 12/2013 | Khazi et al. | |
| 2005/0265016 | A1 | 12/2005 | Rappaport | |
| 2007/0147052 | A1 | 6/2007 | Wyatt | |
| 2009/0086476 | A1 | 4/2009 | Tickner et al. | |
| 2010/0085759 | A1 * | 4/2010 | O'Sullivan et al. | 362/294 |
| 2010/0110699 | A1 | 5/2010 | Chou | |
| 2010/0246193 | A1 | 9/2010 | Clifton et al. | |

* cited by examiner

*Primary Examiner* — John A Ward
(74) *Attorney, Agent, or Firm* — King & Spalding LLP

(57) ABSTRACT

A light emitting diode (LED) lighting system includes a primary enclosure and a secondary enclosure. The primary enclosure can include a fastening feature of a secondary enclosure receiver that is positioned adjacent to an aperture in the primary enclosure. The secondary enclosure can include a corresponding fastening feature that mechanically couples to the fastening feature of the primary enclosure, where the secondary enclosure surrounds the aperture when the secondary enclosure is mechanically coupled to the primary enclosure. The secondary enclosure can further include a passage through which a wire that traverses the aperture in the primary enclosure passes.

20 Claims, 8 Drawing Sheets

SECONDARY ENCLOSURE FOR LIGHT-EMITTING DIODE-BASED LIGHTING SYSTEM

CROSS-REFERENCE TO RELATED APPLICATIONS

This application claims priority under 35 U.S.C. §119 to U.S. Provisional Patent Application Ser. No. 61/588,537, titled "LED-Based Lighting System" and filed on Jan. 19, 2012, the entire contents of which are hereby incorporated herein by reference.

The present application is also related to a patent application titled "Light-Emitting Diode Driver Case," having U.S. patent application Ser. No. 13/463,107 and filed on May 3, 2012, the entire contents of which are hereby incorporated herein by reference.

The present application is further related to U.S. patent application Ser. No. 13/746,649, titled "Attachment Mechanisms for Light-Emitting Diode-Based Lighting System," which is being filed concurrently with the U.S. Patent and Trademark Office.

The present application is further related to U.S. patent application Ser. No. 13/746,835 titled "Optical Attachment Features for Light-Emitting Diode-Based Lighting System," which is being filed concurrently with the U.S. Patent and Trademark Office.

TECHNICAL FIELD

The present disclosure relates generally to an enclosure for a light-emitting diode (LED) fixture, and more particularly, to a secondary enclosure for a LED fixture.

BACKGROUND

Recessed lighting is used in a number of different applications. In a number of cases, recessed lighting uses LED technology to provide one or more of a number of benefits, including but not limited to decreased energy consumption, reduced maintenance, and increased efficacy. LED technologies used with recessed lighting involve relatively confined spaces, and so connecting power and/or control wires to one or more components of a LED lighting system can be difficult.

At times, a splice or other secondary electrical connection is made to a LED lighting system. In such a case, the splice or other secondary electrical connection can be subject to the same electrical and/or mechanical standards as one or more other components of the LED lighting system.

SUMMARY

In general, in one aspect, the disclosure relates to a LED-based lighting system. The LED-based lighting system can include a primary enclosure and a secondary enclosure. The primary enclosure can include a secondary enclosure receiver, where the secondary enclosure receiver includes a fastening feature that is positioned adjacent to an aperture in the primary enclosure. The secondary enclosure can include a corresponding fastening feature that mechanically couples to the fastening feature of the primary enclosure, where the secondary enclosure surrounds the aperture when the secondary enclosure is mechanically coupled to the primary enclosure. The secondary enclosure can also include a passage through which a wire that traverses the aperture in the primary enclosure passes.

These and other aspects, objects, features, and embodiments will be apparent from the following description and the appended claims.

BRIEF DESCRIPTION OF THE DRAWINGS

The drawings illustrate only example embodiments of secondary enclosures for LED systems and are therefore not to be considered limiting of its scope, as the secondary enclosures for LED systems may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
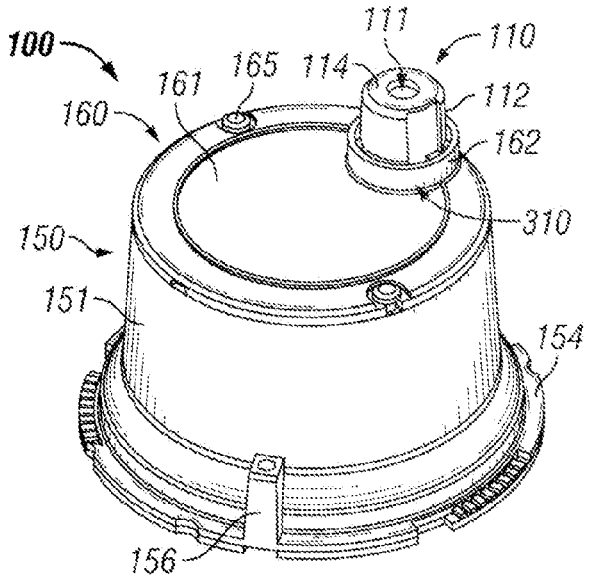
FIGS. 1A-C show various views of a LED-based lighting system that includes a secondary enclosure in accordance with one or more example embodiments.

Example embodiments of secondary enclosures for LED systems will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and height can each generally be described as lateral directions.

While the example embodiments described herein are directed to LED lighting systems, example secondary enclosures can also be used for other types of lighting systems (e.g., fluorescent lighting systems, organic LED lighting systems) and/or with other types of enclosures not related to lighting systems. Therefore, example secondary enclosures described herein should not be considered limited to LED lighting systems. Further, the term "secondary enclosure" is merely an example term used to define an enclosure for a wire splice for a lighting system. A secondary enclosure, as described herein, may be an only enclosure of a LED-based lighting system. Alternatively, a secondary enclosure may be one of several enclosures of a LED-based lighting system. As yet another alternative, a secondary enclosure can be one of two enclosures of a LED-based lighting system.

Example secondary enclosures described herein are directed to enclosing a wire splice or other secondary electrical connection for a lighting system. Wire splices or other secondary electrical connections (hereforward simply called "wire splices" or a "wire splice") can be used for one or more of a variety of reasons. For example, a wire splice can be used to repair existing wiring of an existing system. As another example, a wire splice can be used to retrofit one system for another system (e.g., to retrofit a LED light fixture for an incandescent light fixture). As another example, a wire splice can be used to replace and/or insert an electrical connector piece into a system. An example of a wire splice is a luminaire disconnect, described below.

In certain applications, the example secondary enclosure is subject to one or more of a number of standards and/or regulatory requirements. For example, Underwriter's Laboratories (UL) publishes and maintains standard 1598, which applies to luminaries for use in non-hazardous locations with voltage of 600V nominal or less. Under UL standard 1598, an enclosure of the luminaire is subject to certain tests for impact resistance and flammability. UL standard 1598 states that any splice (e.g., coupling of a male and female connector) must reside within an enclosure. Any openings or holes (apertures) where a splice is made compromises the enclosure under UL standard 1598. As a result, the splice connection must be enclosed to meet UL 1598. A secondary enclosure that easily couples to an appropriate component of the LED-based lighting system may be used to enclose the splice and satisfy the requirements of UL 1598. Thus, an example secondary enclosure that is part of such a luminaire is also subject to these tests for impact resistance and flammability. Such standards and/or regulatory requirements can be applicable to one or more of a number of countries, including but not limited to the United States, Canada, and Mexico.

In order to meet any applicable standards and/or regulatory requirements, example secondary enclosures can be coated with and/or made of one or more of a number of suitable materials. Such materials can include, but are not limited to, metal, 5VA flame-rated plastic, and rubber. The example secondary enclosures can be rigid, be flexible, have one or more other suitable characteristics, or have any combination thereof.

Example embodiments of secondary enclosures described herein are shown and described as having a passage that passes therethrough from one end to another, but otherwise having no other apertures, openings, or other similar features Further, example embodiments of secondary enclosures described herein are shown and described as being of a single piece, as from a mold or using welding to join multiple pieces into a single piece. It is contemplated by this disclosure, however, that example secondary enclosures can be made of two or more detachable pieces or a single piece that has a slot or other feature that allows a user to insert a wire into the passage of the secondary enclosure without disconnecting the wire at either end. Such pieces can couple to each other before and/or after the secondary enclosure is mechanically coupled to the primary enclosure. Such pieces can be coupled to each other using one or more of a number of coupling methods, including but not limited to clips, snap fittings, mating threads, and compression fittings.

Figure 1B:
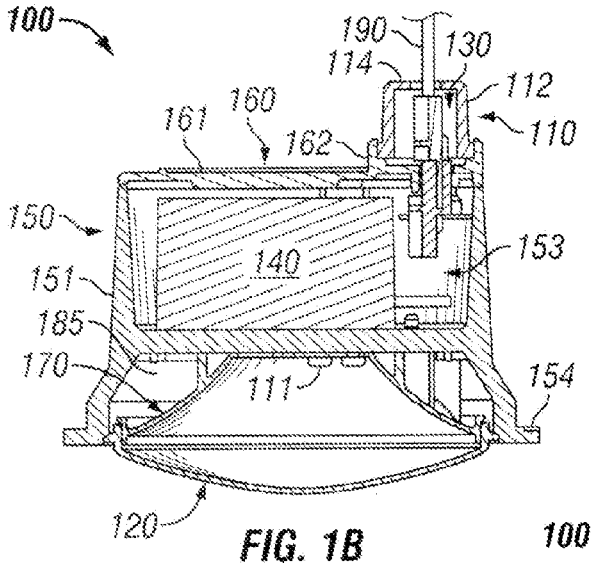
Figure 1C:
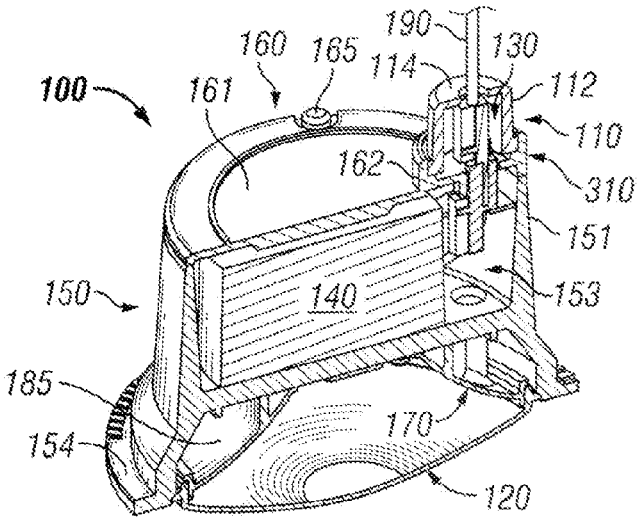

FIGS. 1A-C show various views of a LED-based lighting system 100 that includes a secondary LED enclosure 110 in accordance with one or more example embodiments. Specifically, FIG. 1A shows a perspective view of the LED-based lighting system 100. Further, FIG. 1B shows a cross-sectional side view of the LED-based lighting system 100, and FIG. 1C shows a perspective cross-sectional side view of the LED-based lighting system 100. In one or more embodiments, one or more of the components shown in FIGS. 1A-C may be omitted, repeated, and/or substituted. Accordingly, embodiments of LED-based lighting systems using a secondary enclosure should not be considered limited to the specific arrangements of components shown in FIGS. 1A-C.

Referring now to FIGS. 1A-C, the LED-based lighting system 100 in this example is shown having a primary enclosure 150, a top plate assembly 160, an optional connector assembly 130, a reflector 170, a diffuser 120, and a secondary enclosure 110. The primary enclosure 150 is defined by an enclosure wall 151 that forms, in a lower region, a cavity 185 and surface for receiving and mounting one or more LEDs 111, such as chip-on-board LEDs. The enclosure wall 151 of the primary enclosure 150 in FIGS. 1A-C also forms, in an upper portion, another cavity 153 for receiving the LED driver 140 and the optional connector assembly 130. The LEDs 111 can be mounted on an upper surface of the cavity 185, on the surface opposite the bottom surface of the cavity 153 where the LED driver 140 and its associated circuitry are located. In some cases, the enclosure wall has one or more apertures that allow wires, connectors, and/or other components of the LED-based lighting system 100 to pass between the cavity 185 and the cavity 153.

In certain example embodiments, the primary enclosure 150 houses one or more other components, acts as a heat sink that receives heat from one or more components that generate heat, such as LEDs 111 and the LED driver 140, and dissipates the heat. The primary enclosure 150 can be a single piece construction (e.g., die cast) or an assembly of multiple pieces. Optionally, the primary enclosure 150 includes a removable top plate assembly 160. The top plate assembly 160, when removed, allows access to the cavity 153 inside the primary enclosure 150 as well as any components positioned inside the cavity 153.

The bottom portion of the primary enclosure 150 can include one or more of a number of features. For example, as shown in FIGS. 1A-C, the primary enclosure 150 can include a bottom flange 154 and a mounting post 156. The bottom flange 154 can be shaped and sized to mechanically couple to the trim (not shown, but described in U.S. patent application Ser. No. 13/746,649, titled "Attachment Mechanisms for Light-Emitting Diode-Based Lighting System," which is being filed concurrently with the U.S. Patent and Trademark Office, the entire contents of which are hereby incorporated by reference) and/or the diffuser 120 of the LED-based lighting system 100.

Figure 9:
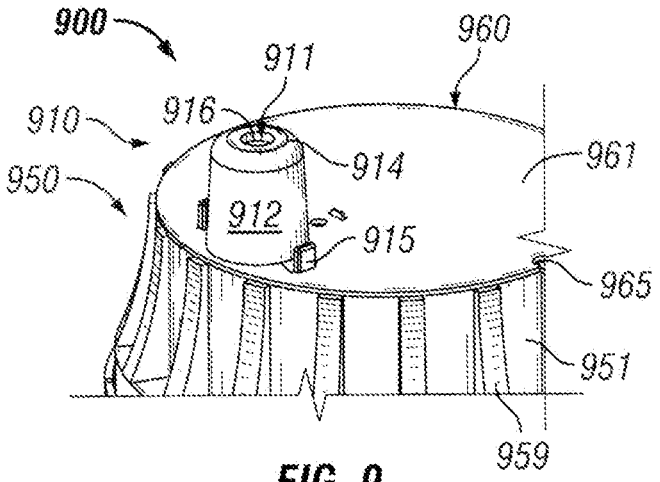
FIG. 9 shows a perspective view of yet another LED-based lighting system that includes another alternative secondary enclosure in accordance with one or more example embodiments.

The mounting post 156 can be any type of feature used to mount the LED-based lighting system 100 to a downlight can, a junction box, or any other type of lighting fixture housing. The mounting post 156 can come in one or more of a number of other forms, including but not limited to a spring clip. The enclosure wall 151 of the primary enclosure 150 can be smooth or have one or more of a number of protrusions (e.g., fins, as shown in FIG. 9 below) to increase the surface area of the primary enclosure 150 and more efficiently dissipate heat absorbed from the LED driver 140 and/or other components of the LED-based lighting system 100.

The top plate assembly 160 can include a top plate 161, a retainer 162 of a secondary enclosure receiver 310 (described in more detail below in FIG. 3), and one or more coupling features (e.g., apertures in this example, mating threads). The top plate assembly 160 may be coupled to the enclosure wall 151 of the primary enclosure 150 using one or more of a number of fastening methods, including but not limited to threaded couplings, a clamp, and threaded fasteners. In this example, the top plate assembly 160 is coupled to the enclosure wall 151 using screws 165 that traverse apertures 365 in the top plate 161. The primary enclosure 150 and/or the top plate assembly 160 can be made of one or more of a number of suitable materials (e.g., aluminum, alloy) that conducts and dissipates heat. One or more features (e.g., gaskets or other sealing members) may be used to provide a certain environment (e.g., dust free, moisture free) within the cavity 153 of the primary enclosure 150 when the top plate assembly 160 is coupled to the enclosure wall 151.

The secondary enclosure receiver 310, when mechanically coupled to the top plate assembly 160, can be integrated with the top plate assembly 160 as a single piece construction (e.g., die cast) or as an assembly of multiple pieces. In addition, or in the alternative, the secondary enclosure receiver 310, when mechanically coupled to the enclosure wall 151 of the primary enclosure 150, can be integrated with the enclosure wall 151 as a single piece construction (e.g., die cast) or as an assembly of multiple pieces. The secondary enclosure receiver 310 can be made of one or more of a number of materials, including but not limited to the materials of the top plate 161 and/or the enclosure wall 151.

The top plate assembly 160 (or, in the absence of the top plate assembly 160, the top surface of the enclosure wall 151 that covers the cavity 153) also includes an aperture (covered by the secondary enclosure 110 and positioned within the retainer 162) that is sized and shaped to receive one or more wires and/or one or more optional connectors 130 (also called luminaire disconnects 130). In certain example embodiments, the aperture (see element 319 of FIG. 3 below), and thus the retainer 162, is positioned in the top plate assembly 160. For example, the aperture and the retainer 162, in the top plate assembly 160 can include side walls that define a cavity for slidable insertion or snap-fit insertion of the luminaire disconnect 130. Alternatively, the aperture and the retainer 162, can be disposed in an outer wall of the enclosure wall of the primary enclosure 150 or in a portion of the outer wall and a portion of the top plate assembly 160.

The example aperture surrounded by the retainer 162, can be defined by three generally vertical walls with an opening for insertion, removal, or simply manual access provided along an area which would have been the fourth vertical wall or from above or below the aperture. In this example embodiment, tabs (not shown) or portions of the enclosure wall 151 can extend into the aperture to reduce at least a portion of the lateral dimension of the aperture and prevent a portion of the luminaire disconnect 130 from falling out of the aperture. Alternatively, the aperture can be defined by four generally vertical walls, with insertion and removal provided from above or below the aperture.

In certain example embodiments, the aperture surrounded by the retainer 162 also receives another portion of the luminaire disconnect 130. The aperture surrounded by the retainer 162 may be sized and/or positioned based on one or more of a number of factors, including but not limited to the size and shape of one or more portions of the luminaire disconnect 130, and the manner in which the portions of the luminaire disconnect 130 couple to each other.

For example, the aperture surrounded by the retainer 162 can be shaped to conform to the top portion of the luminaire disconnect 130. The example aperture surrounded by the retainer 162 can be larger than the top portion of the luminaire disconnect 130. Additional information about the luminaire disconnect 130 can be found in the patent application titled "Light-Emitting Diode Driver Case," having U.S. patent application Ser. No. 13/463,107 and filed on May 3, 2012, the entire contents of which are hereby incorporated herein by reference.

In certain example embodiments, the LED driver 140 can include a housing that encloses driver circuitry. The housing for the LED driver 140 can be a single piece construction (e.g., die cast) or an assembly of multiple pieces. The housing for the LED driver 140 can be made of one or more of a number of suitable materials (e.g., plastic, aluminum, alloy) that absorbs and dissipates heat. The housing for the LED driver 140 is sized so that the housing can be positioned within the cavity 153 of the primary enclosure 150.

The driver circuitry of the LED driver 140 can include a power supply for the LEDs 111. Specifically, the driver circuitry of the LED driver 140 can receive power, process the power, and deliver the processed power to the one or more LEDs 111. The driver circuitry can also receive, process, and/or deliver control signals to the LED 111. The control signals can be received from the same wiring as that providing the source of power to the driver circuitry, from other wiring, or by way of wireless signal, such as RF, with the inclusion of a receiver or transceiver (not shown). The driver circuitry can be located inside the housing for the LED driver 140 or coupled to an exterior surface of the housing. The driver circuitry can include one or more discrete components (e.g., transformer, resistor, relay), one or more hardware processors, or any suitable combination thereof.

In certain example embodiments, the driver circuitry is electrically coupled to at least a portion of the luminaire disconnect 130 by one or more wires. Specifically, the luminaire disconnect 130 can provide power and/or control to one or more components (e.g., the driver circuitry) of the LED driver 140. In addition, or in the alternative, the luminaire can provide power and/or control and/or one or more other devices within the cavity 153. The luminaire disconnect 130 can be made of one or more of a number of materials, including but not limited to plastic, rubber, aluminum, and copper. The example luminaire disconnect 130 can include an electrically non-conductive housing and one or more conductive terminal contacts disposed within the non-conductive housing. In certain example embodiments, the non-conductive housing is constructed of plastic, such as by molding, while the terminal contacts are made of a conductive material, such as copper or aluminum, to assist in forming and maintaining an electrical coupling. In certain example embodiments, the terminal contacts permit quick, push-in wire termination for the conductive portions of the wires 190.

The reflector 170 of the LED-based lighting system 100 surrounds the LED 111 within the cavity 185. The reflector can be made of a reflective material and is shaped in such a way as to disburse and distribute the light emitted by the LED 111 in a desired fashion. Similarly, the diffuser 120 (sometimes called a lens) is mechanically coupled to the bottom portion of the reflector 170 and is used to filter, disburse, and distribute the light emitted by the LED 111 in a desired fashion. The diffuser 120 can be shaped in any of a number of ways and/or can be made of one or more of a number of materials suitable to create the desired distribution of light emitted by the LEDs 111.

The secondary enclosure 110 is disposed within the retainer 162 and surrounds the aperture in the top plate assembly 160, which in this example is filled with the luminaire disconnect 130. The secondary enclosure 110 includes a side wall 112 and a top surface 114. The secondary enclosure includes a passage through which the upper portion of the luminaire disconnect 130 and the wire 190 pass. More details of the secondary enclosure 110 are described below with respect to FIG. 2.

The wire 190 that passes through the aperture 111 in the secondary enclosure 110 can be any type of conductor and/or cable capable of carrying voltage and/or current. The wire 190 can be made of an electrically conductive material (e.g., copper, aluminum) and can have one or more electrically non-conductive materials (e.g., rubber, nylon, plastic) wrapped around the electrically conductive material. The electrically conductive material of the wire 190 can be one of a number of sizes (e.g., 4 American wire gauge (AWG), 12 AWG, 16 AWG) that allow the wire 190 to carry the voltage and/or current required for the LED-based lighting system 100.

Figure 2:
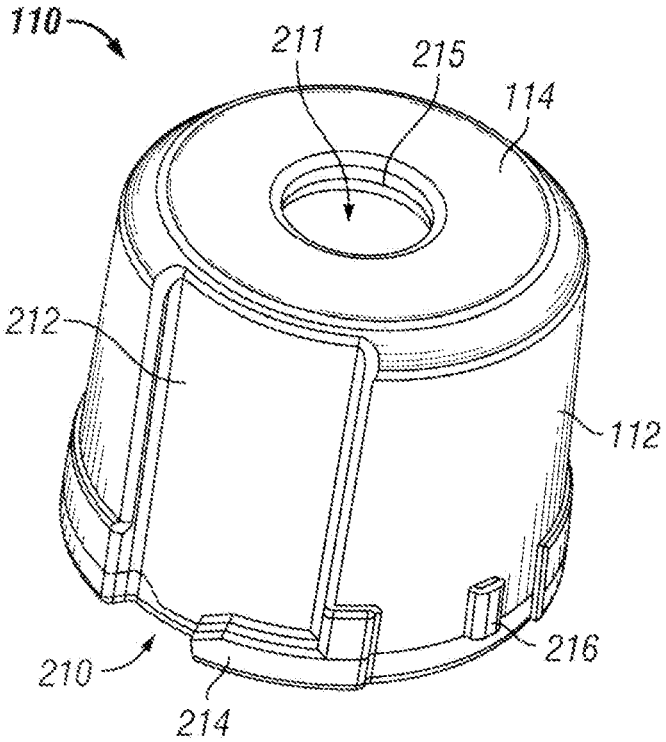
FIG. 2 shows a perspective view of the secondary enclosure of FIGS. 1A-C in accordance with one or more example embodiments.

FIG. 2 shows a perspective view of the secondary enclosure 110 of FIGS. 1A-C in accordance with one or more example embodiments. In one or more embodiments, one or more of the configurations and/or features shown in FIG. 2 may be omitted, repeated, and/or substituted. Accordingly, embodiments of a secondary enclosure should not be considered limited to the specific configurations and/or features shown in FIG. 2.

Referring now to FIGS. 1A-2, the example secondary enclosure 110 includes a side wall 112 and a top surface 114. The top surface 114 has a hole 215 defined by a perimeter, where the hole 215 marks one end of the passage 216 that traverses the length of the secondary enclosure 110. The thickness of the side wall 112 and/or the top surface 114 can vary, but is at least sufficient to allow the secondary enclosure 110 to pass the tests for impact-resistance and flammability required by UL standard 1598. The outer surface of the side wall 112 and/or the top surface 114 can be flat, curved, angled, have some other feature, or any combination thereof.

In certain example embodiments, the perimeter of the passage 211 at the narrowest point in the passage 211 (usually, as in this example, at the hole 215) is large enough to accommodate the wire 190 that passes therethrough. In some cases, the hole 215 can include a sealing member (not shown) (e.g., a gasket, an o-ring, silicon) that is disposed along an inner surface of the passage 211 and through which the wire 190 passes. For example, a sealing member can be disposed along the perimeter of the hole 215, where the sealing member can form a seal around the wire 190 to keep certain elements (e.g., dirt, water, moisture) from tracking down the wire 190 into the passage 211. In certain example embodiments, when the secondary enclosure 110 is mechanically coupled to the primary enclosure 150, the sealing member tightens around the wire 190. Similarly, the sealing member can retract from the wire 190 when the secondary enclosure 110 is mechanically decoupled to the primary enclosure 150.

The angle at which the side wall 112 meets the top surface 114 can vary, including but not limited to 90° (perpendicular). The cross-sectional area of the secondary enclosure 110 can take the form of one or more of a number of shapes. For example, as shown in FIGS. 1A-2, the cross-sectional area of the secondary enclosure 110 is substantially circular along the length of the secondary enclosure 110. Other shapes can include, but are not limited to, an oval, a square, a triangle, and an octagon.

The side wall 112 can include one or more features to assist in mechanically coupling the secondary enclosure 110 to the primary enclosure 150. For example, as shown in FIG. 2, a recessed area 212 that traverses the length of the secondary enclosure 110 can be disposed on a portion of the side wall 112. In such a case, the recessed area 212 allows for a fastening feature 210 to be accessible to a corresponding fastening feature of the secondary enclosure receiver 310 (described below with respect to FIG. 3). The fastening feature 210 can include one or more of a number of features that allow the secondary enclosure 110 to mechanically couple to the primary enclosure 150 in such a manner as to meet any applicable standards and/or regulations.

For example, as shown in FIG. 2, the fastening feature 210 includes a bayonet pin 214 that extends along the bottom edge of the secondary enclosure 110 for a portion of the width of the recessed area 212. In such a case, when the bayonet pin 214 is properly aligned with a corresponding fastening feature (element 314 of FIG. 3) of the secondary enclosure receiver 310, a rotation of the secondary enclosure 110 in a clockwise direction for approximately 1/12 of a turn allows the bayonet pin 214 to mechanically couple to the corresponding fastening feature of the secondary enclosure receiver 310, which in turn mechanically couples the secondary enclosure 110 to the primary enclosure 150. Alternatively, the secondary enclosure 110 can be rotated counter-clockwise, more than approximately 1/12 of a turn (e.g., multiple turns, a half turn), and/or less than 1/12 of a turn. Other features, as an alternative to the bayonet pin 214, can be used, including but not limited to mating threads, a compression fitting, and a snap lock. A secondary enclosure 110 can have more than one fastening feature 210.

In addition, as shown in FIG. 2, the secondary enclosure 110 can optionally include a retaining feature 216 that interlocks with a corresponding retaining feature (element 316 in FIG. 3) disposed on the secondary enclosure receiver 310 when the secondary enclosure 110 is mechanically coupled to the primary enclosure 150. In this case, the retaining feature 216 is a bump or protrusion that fits into a corresponding recess in the secondary enclosure feature 310. In addition, or in the alternative, other retaining features can be disposed on the secondary enclosure 110, including but not limited to a retractable pin, a spring clip, and a recess. A secondary enclosure 110 can have more than one retaining feature 216.

In this example, the fastening feature 210 and the retaining feature 216 are disposed on the outer surface of the side wall 112 along the bottom end of the side wall 112. In addition, or in the alternative, the fastening feature 210 and/or the retaining feature 216 can be disposed at other locations of the secondary enclosure 110. For example, the retaining feature 216 can be disposed on a bottom edge of the secondary enclosure 110. In any case, wherever a fastening feature 210 and a retaining feature 216 are disposed on the secondary enclosure 110, a corresponding feature is disposed in a corresponding location of the secondary enclosure receiver 310.

Figure 3:
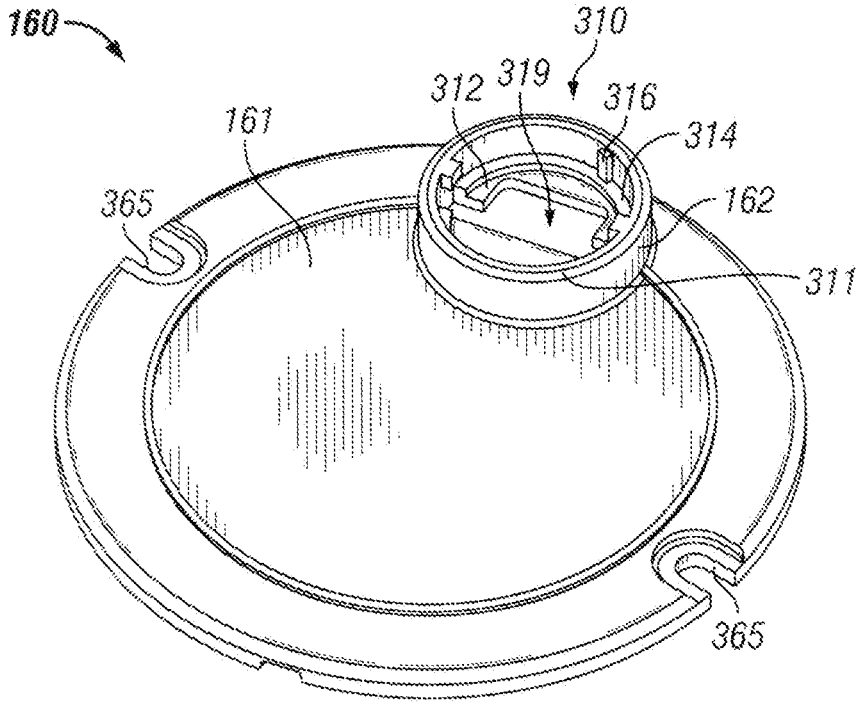
FIG. 3 shows a perspective view of the secondary enclosure receiver of the top plate assembly of FIGS. 1A-C, in accordance with one or more example embodiments.

FIG. 3 shows a perspective view of the secondary enclosure receiver 310 of the top plate assembly 160 of FIG. 1, in accordance with one or more example embodiments. In one or more embodiments, one or more of the configurations and/or features shown in FIG. 3 may be omitted, repeated, and/or substituted. Accordingly, embodiments of a secondary enclosure should not be considered limited to the specific configurations and/or features shown in FIG. 3.

Referring now to FIGS. 1A-3, the example secondary enclosure receiver 310 is part of the top plate assembly 160. In addition, or in the alternative, the secondary enclosure receiver 310 can be part of one or more surfaces of the enclosure wall 151 of the primary enclosure 150. In any case, the secondary enclosure receiver 310 is positioned adjacent to the aperture 319 in the primary enclosure 150. In this example, the aperture 319 is in the top plate 161, and the secondary enclosure receiver 310 surrounds the perimeter (delineated by element 312) of the aperture 319.

The secondary enclosure receiver 310 includes a wall 162 that protrudes away from the top surface of the top plate 161. The wall 162 of the secondary enclosure receiver 310 can have a shape and/or inner perimeter that is slightly larger than the shape and/or outer perimeter of the side wall 112 of the secondary enclosure 110. In other words, the secondary enclosure 110 can fit within the secondary enclosure receiver 310 so that the secondary enclosure 110 can mechanically couple to the primary enclosure 150. Alternatively, the wall 162 of the secondary enclosure receiver 310 can have a shape and/or inner perimeter that is slightly smaller than the shape and/or outer perimeter of the side wall 112 of the secondary enclosure 110. In other words, the secondary enclosure 110 can fit over the secondary enclosure receiver 310 so that the secondary enclosure 110 can mechanically couple to the primary enclosure 150. Other alternative configurations of the shape and/or perimeter of the secondary enclosure 110 and the secondary enclosure receiver 310 can exist in certain example embodiments.

In certain example embodiments, the size and/or perimeter of the aperture 319 is at least slightly larger than a size and/or perimeter of the outer surface of a luminaire disconnect 130 that can, if present, be disposed within the aperture 319. In some cases, one or more surfaces where the side wall 112 contacts the secondary enclosure receiver 310 when the secondary enclosure 110 is mechanically coupled to the secondary enclosure receiver 310 can include a sealing member (not shown) that is disposed along such surfaces.

The wall 162 has a top end 311 that can be flat, rounded, jagged, end at a point, have some other shape, or have any combination thereof. The angle at which the wall 162 meets the top end 311 can vary, including but not limited to 90° (perpendicular). The cross-sectional area of the wall 162 can take the form of one or more of a number of shapes. For example, as shown in FIGS. 1A-3, the cross-sectional area of the wall 162 is substantially circular along the length of the wall 162. Other shapes can include, but are not limited to, an oval, a square, a triangle, and an octagon. The shape of the wall 162 is sufficient to allow the secondary enclosure 110 to mechanically couple to the primary enclosure 150.

The wall 162 can include one or more features to assist in mechanically coupling the secondary enclosure 110 to the primary enclosure 150. For example, as shown in FIG. 3, a fastening feature 314 in the form of a notch or ramp is accessible to the bayonet pin 214 (a corresponding fastening feature) of the secondary enclosure 110. In certain example embodiments, the bayonet 214 and the fastening feature 314 are mating threads. In such a case, the mating threads can allow for less than one rotation of the secondary enclosure 110 or more than one rotation of the secondary enclosure 110 for the secondary enclosure 110 to mechanically couple to the primary enclosure 150. The fastening feature 314 can include one or more of a number of features that correspond to the fastening feature 214 of the secondary enclosure 110 and allow the secondary enclosure 110 to mechanically couple to the primary enclosure 150 in such a manner as to meet any applicable standards and/or regulations. Other examples of a fastening feature can include, but are not limited to, mating threads, a compression fitting, and a snap lock. A secondary enclosure receiver 310 can have more than one fastening feature 314.

In addition, as shown in FIG. 3, the secondary enclosure receiver 310 can optionally include a retaining feature 316 that interlocks with a corresponding retaining feature 216 disposed on the secondary enclosure 110 when the secondary enclosure 110 is mechanically coupled to the primary enclosure 150. In this case, the retaining feature 316 is a recess that receives a corresponding bump or protrusion in the secondary enclosure 110. In addition, or in the alternative, other retaining features can be disposed on the secondary enclosure receiver 310, including but not limited to an aperture, a notch, and a bump or protrusion. A secondary enclosure receiver 310 can have more than one retaining feature 316.

In this example, the fastening feature 314 and the retaining feature 316 are disposed on the inner surface of the wall 162 along the bottom end of the wall 162. In addition, or in the alternative, the fastening feature 314 and/or the retaining feature 316 can be disposed at other locations of the secondary enclosure receiver 310. For example, the retaining feature 316 can be disposed on the top side 311 of the wall 162. In any case, wherever a fastening feature 314 and a retaining feature 316 are disposed on the secondary enclosure receiver 310, a corresponding feature is disposed in a corresponding location of the secondary enclosure 110.

Figure 4:
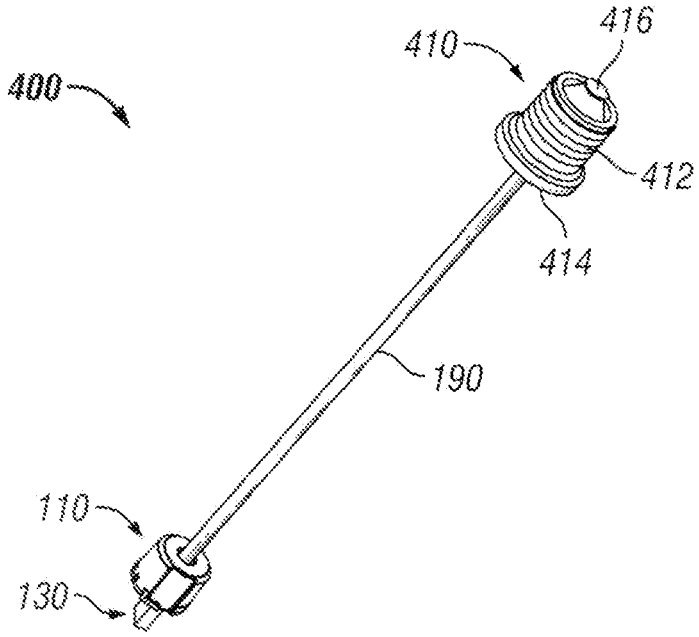
FIG. 4 shows a perspective view of an adaptive feature electrically coupled to a secondary enclosure in accordance with one or more example embodiments.
Figure 5A:
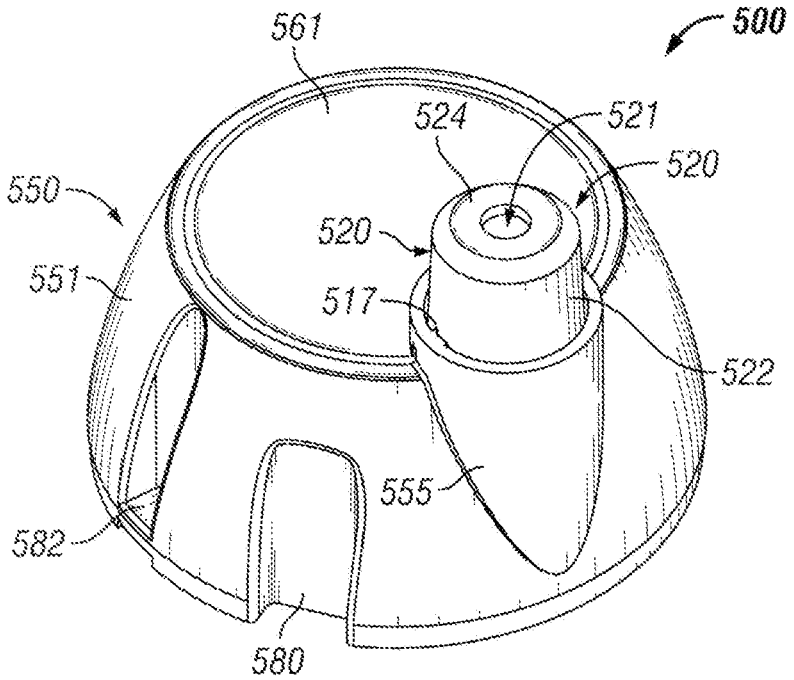
FIGS. 5A-E show various views of an alternative LED-based lighting system that includes a secondary enclosure in accordance with one or more example embodiments.
Figure 5B:
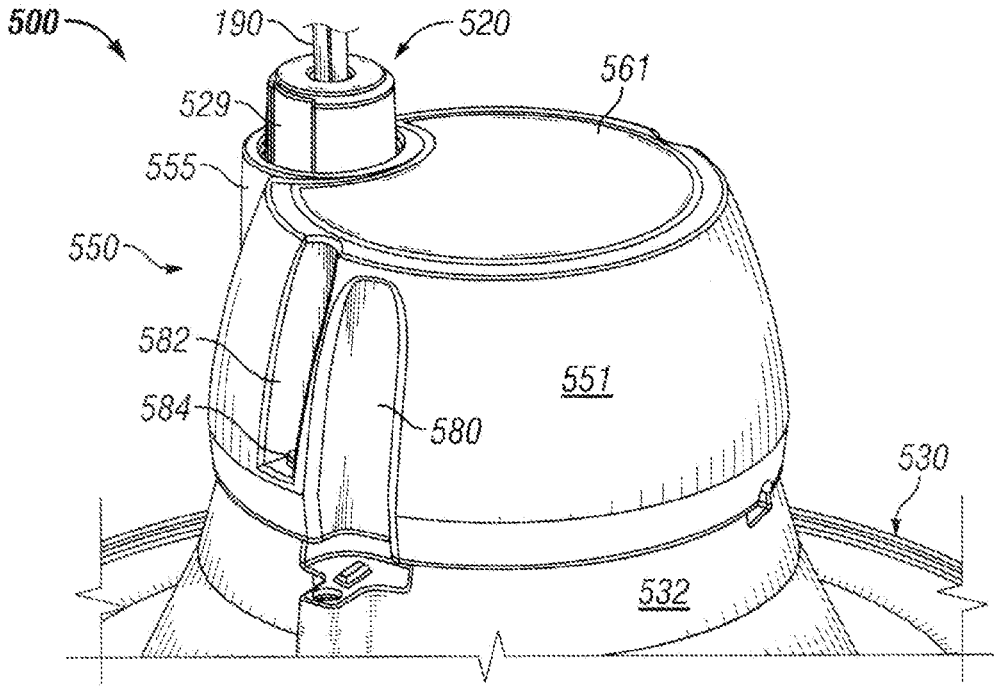
Figure 5C:
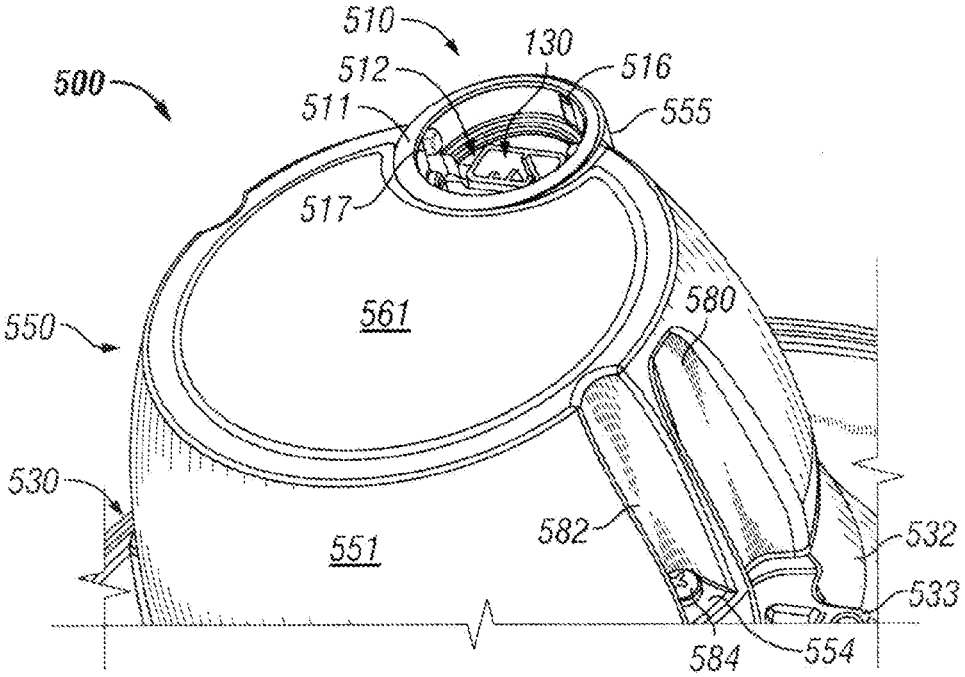
Figure 5D:
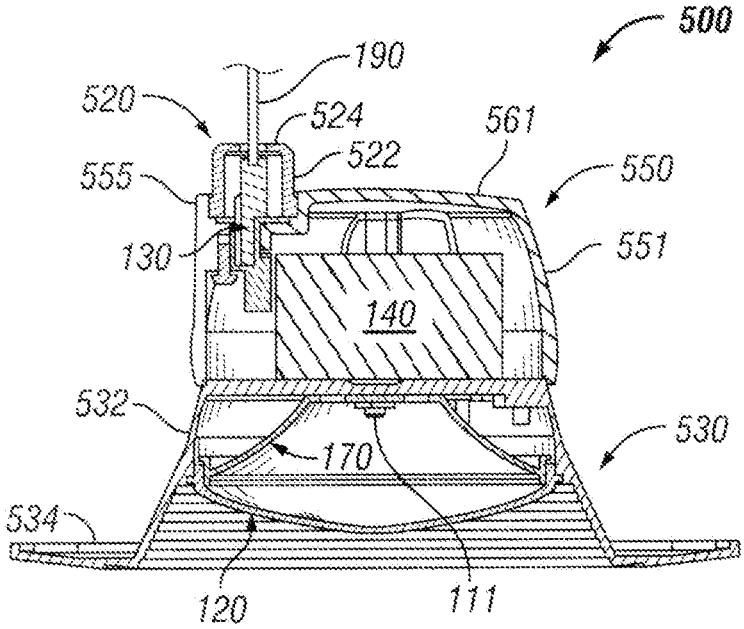
Figure 5E:
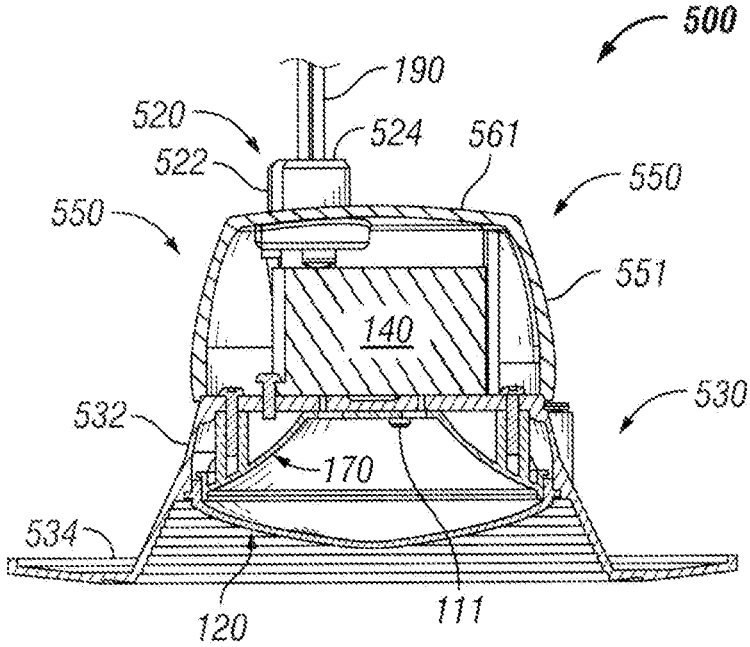

FIG. 4 shows a perspective view of an adaptive feature 410 electrically coupled to a secondary enclosure 110 in accordance with one or more example embodiments. Referring to FIGS. 1A-4, the adaptive feature 410 can be electrically coupled to the secondary enclosure 110 using the wire 190. The adaptive feature 410 in this example is an adapter for an Edison socket. Specifically, the adaptive feature 410 includes a base 414, from which extends a threaded collar 412 that is topped with an electrically conductive contact pad 416 for screwing into an existing Edison socket. This adaptive feature 410 allows a LED lighting fixture (e.g., the LED-based lighting system 100) to be retrofit into an existing electrical fixture with minimal cost and electrical work. Other types of adaptive features 410 can be electrically coupled to the secondary enclosure 110. Examples of such other adaptive features can include, but are not limited to, a connective pin, a switch, a control panel, and a socket for a fluorescent light fixture.

FIGS. 5A-E show various views of an alternative LED-based lighting system 500 that includes a secondary enclosure 520 in accordance with one or more example embodiments. The LED-based lighting system 500 of FIGS. 5A-E and its components are substantially similar to the LED-based lighting system 100 of FIGS. 1A-3 and its components, except as described below.

The LED-based lighting system 500 shows a trim 530 that is mechanically coupled to the bottom of the primary enclosure 550. In this example, a fastening device 584 (e.g., a screw) is accessed through a slot 582 in the enclosure wall 551 of the primary enclosure 550 and traverses an aperture in the resulting bottom flange 554 of the primary enclosure 550. The aperture in the bottom flange 554 of the primary enclosure 550 can be aligned with a corresponding aperture in the trim 530 so that the trim 530 mechanically couples to the primary enclosure 550 when the fastening device 584 traverses the apertures. In addition, or in the alternative, the primary enclosure 550 and the trim 530 can be mechanically coupled to each other in one or more of a number of other ways, including but not limited to mating threads, solder, welding, and compression fittings.

The enclosure wall 551 can have other slots and/or features, such as slot 580, which allows for access to a friction pin mounting post 533 on the trim 530. As another example, the enclosure wall 551 can include a secondary enclosure receiver 510. In such a case, as in this example, there is no top plate assembly. Rather, the top surface 561 of the primary enclosure 550 can be integrated with the enclosure wall 551 as one piece. Further, the side of the enclosure wall 551 adjacent to the secondary enclosure receiver 510 can have a protrusion 555 to allow for passage of the wire 190 and/or the luminaire disconnect 130.

The various features (e.g., retaining feature 516, fastening features 514, passage 521, recessed area 529) of the secondary enclosure receiver 510 and the secondary enclosure 520 are substantially similar to those described above with respect to FIGS. 1A-3. The location of the secondary enclosure receiver 510 on the primary enclosure can be anywhere on the top and/or side of the primary enclosure 510. For example, an annular notch 517 (protrusion) may be positioned along the inner surface of the secondary enclosure receiver 510. Further, the outer surface of the side wall 522 of the secondary enclosure 520 may have a corresponding receiving notch (fastening feature) that couples to the annular notch 517 when the secondary enclosure 520 is in a certain position when coupled to the secondary enclosure receiver 510. In such a case, the annular notch 517 may prevent the secondary enclosure 520 from rotating within or shaking loose from the secondary enclosure receiver 510.

Figure 6:
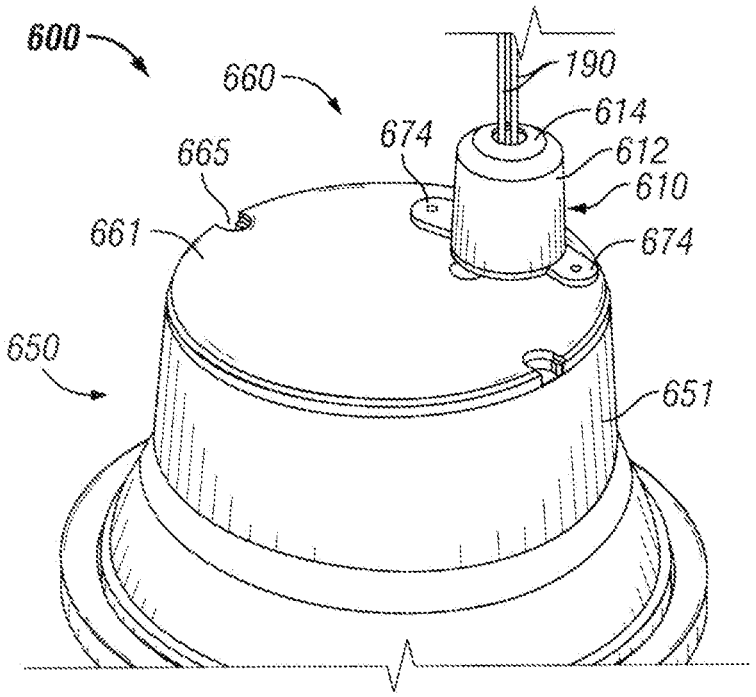
FIG. 6 shows a perspective view of yet another LED-based lighting system that includes an alternative secondary enclosure in accordance with one or more example embodiments.
Figure 7:
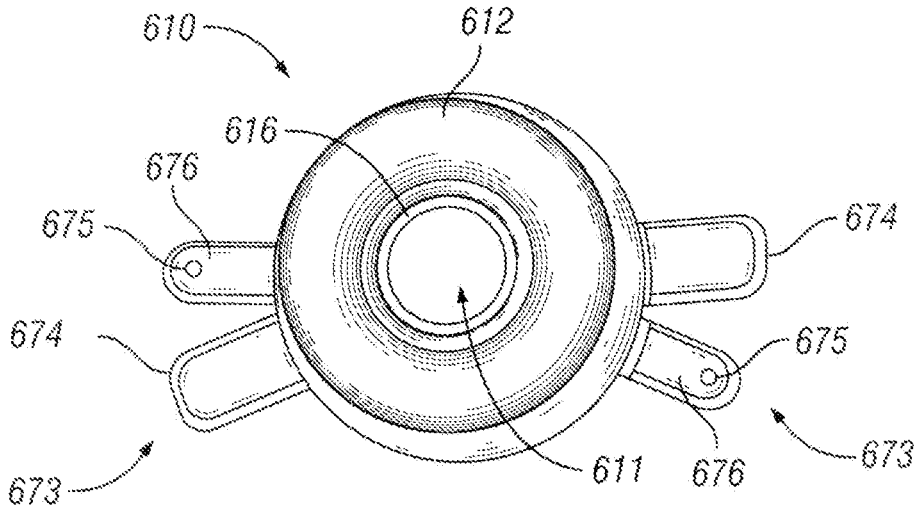
FIG. 7 shows a top view of the secondary enclosure of FIG. 6 in accordance with one or more example embodiments.

FIG. 6 shows a perspective view of a LED-based lighting system 600 that includes an alternative secondary enclosure 610 in accordance with certain example embodiments. FIG. 7 shows a top view of the secondary enclosure 610 of FIG. 6. The LED-based lighting system 600 of FIGS. 6 and 7 and its components are substantially similar to the LED-based lighting system 100 of FIGS. 1A-3 and its components, except as described below.

The secondary enclosure 400 of FIGS. 6 and 7 includes a top surface 614 and a side wall 612. The fastening feature 673 of the secondary enclosure 400 includes two pairs of locking tabs 676 that are located on opposite sides of the secondary enclosure 400. The locking tabs 676 extend radially outward from the outer perimeter of the side wall 612 along the bottom side of the bottom wall 612. One or both of the locking tabs 676 rotate toward one of a corresponding pair of cover tabs 674. When a locking tab 676 is covered by a corresponding cover tab 674, the fastening feature 673 is engaged. Likewise, the fastening feature 673 is disengaged when the locking tabs 676 is rotated away from under the cover tab 674.

When the locking tab 676 and the cover tab 674 overlap, the fastening feature 673 is engaged and secures the secondary enclosure 610 to the top plate assembly 660, and thus to the primary enclosure 650. Specifically, when the locking tab 676 and a corresponding cover tab 674 overlap, a mechanism (e.g., a latch, a protruding member, suction cups) inside of the secondary enclosure 610 along the bottom side is enabled. By being enabled, this mechanism engages a complementary fastening feature (e.g., an aperture, a recessed area) on the top plate assembly 660 (or the primary enclosure 650 if there is no top plate assembly 660) and/or the luminaire disconnect 130.

In addition to acting as a fastening feature 673, each pair of locking tabs 676 can also act as retaining features. For example, one of the locking tabs 676 can have a raised feature 675 that, when aligned with the cover tab 674 and/or another locking tab 676, is disposed in a recess (not shown) on the back side of such other tab that complements the size and shape of the raised feature 675. In certain example embodiments, there is only one locking tab 676 and one cover tab 674. Alternatively, there can be more than two locking tabs 676 and an equal number of cover tabs 674. In yet another alternative embodiment, more than one locking tab 676 can be covered by a single cover tab 674.

The secondary enclosure 610 can also include a passage 611 that traverses the length of the secondary enclosure 610 and through which the wire 190 and/or a luminaire disconnect 130 may traverse. The opening 616 at the top end of the secondary enclosure 610 may be adjustable to enclose and form a seal around any size and/or shape of wire 190 that traverses the opening 616.

Figure 8A:
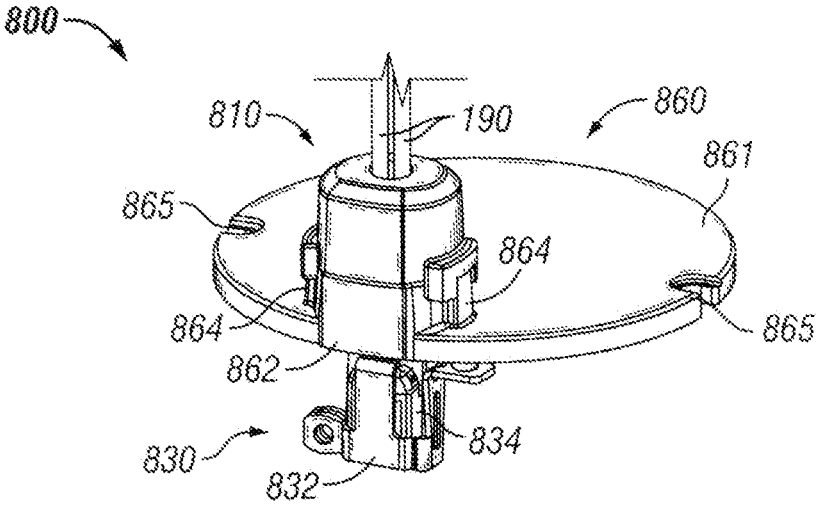
FIGS. 8A and 8B show various views of still another LED-based lighting system that includes another alternative secondary enclosure in accordance with one or more example embodiments.
Figure 8B:
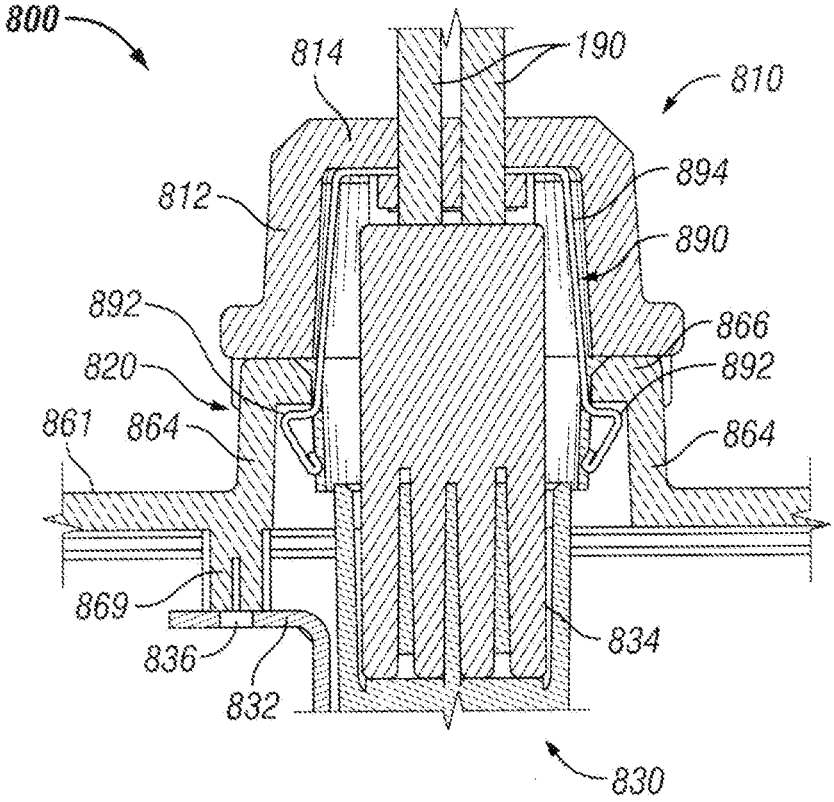

FIGS. 8A and 8B show a perspective view and a cross-sectional side view, respectively, of a portion of another LED-based lighting system 800 that includes an alternative secondary enclosure 810 in accordance with one or more example embodiments. The LED-based lighting system 800 of FIGS. 8A and 8B and its components are substantially similar to the LED-based lighting system 100 of FIGS. 1A-3 and its components, except as described below.

In this case, the secondary enclosure 810 is mechanically coupled to a secondary enclosure receiver 820 that protrudes upward from the top plate 861 of the top plate assembly 860. The secondary enclosure receiver 820 may couple to the top surface of the top plate 161 using one or more of a number of coupling methods, including but not limited to adhesive, snap fittings, twist-lock mechanisms, spring mechanisms, and threaded fasteners. In addition, or in the alternative, the secondary enclosure receiver 820 and the top plate 861 can be part of a single piece.

As shown in FIG. 8B, a fastening pin 836 can traverse an aperture in the top side of a connector mounting bracket 832 and also couple to a protrusion 869 of the secondary enclosure receiver 820 and/or the top plate 861. The connector mounting bracket 832 can be used to hold the luminaire disconnect 830 in place. The top portion 834 of the luminaire disconnect 830 protrudes above the plane of the top plate 861 and is disposed within a cavity formed by the secondary enclosure receiver 820 and the passage of the secondary enclosure 810. The wire 190 extend from the top side of the top portion 834 of the luminaire disconnect 830 and through the hole in the top end 814 of the secondary enclosure 810.

In one or more example embodiments, the secondary enclosure 810 includes one or more spring clips 890 disposed on the interior of the secondary enclosure 810 within the passage. Each spring clip 890 can include an arm 894, at the distal end of which is disposed the clip 892. Each spring clip 890 is has a size and shape that allows the clip 892 to engage an inward protrusion 866 in the top end of the secondary disconnect receiver 820 when the spring clip 890 is in a natural position (i.e., does not have an additional force applied to the secondary enclosure 810). Each inward protrusion 866 can extend from an end wall 864 that is adjacent to the retainer 862 of the secondary enclosure receiver 820. The clips 892 can be disengaged from the inward protrusions 866 by pressing (applying a force) on the side wall 812 of the secondary enclosure at opposite ends where the spring clips 890 are disposed. By applying such an inward force, the arms 894 move inward (putting the spring clips 890 in an unnatural position), which force the clips 892 to move inward and clear the inward protrusions 866.

Figure 10:
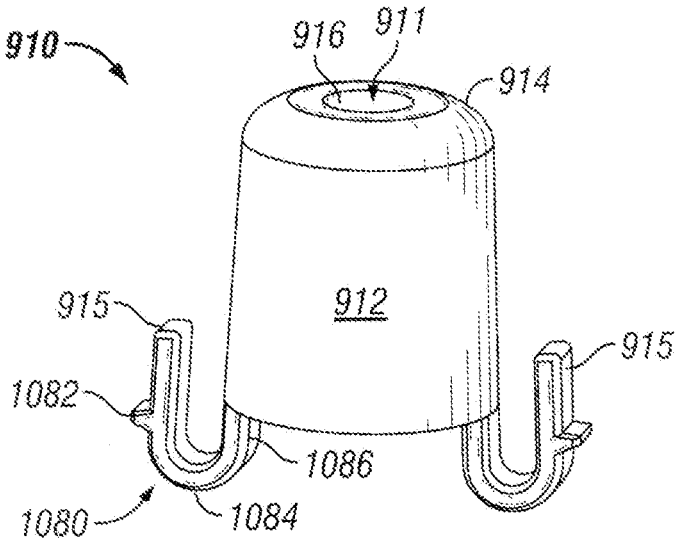
FIG. 10 shows a perspective side view of the secondary enclosure of FIG. 9 in accordance with one or more example embodiments.

FIG. 9 shows a perspective view of a LED-based lighting system 900 that includes an alternative secondary enclosure 910 in accordance with certain example embodiments. FIG. 10 shows a top view of the secondary enclosure 910 of FIG. 9. The LED-based lighting system 900 of FIGS. 9 and 10 and its components are substantially similar to the LED-based lighting system 100 of FIGS. 1A-3 and its components, except as described below.

In this example embodiment, the secondary enclosure 910 includes a pair of enclosure clips 1080 along its base, where the enclosure clips 1080 serve as the fastening feature and the retaining feature. The enclosure clips 1080 can protrude downward away from the bottom end of the side wall 912 of the secondary enclosure 910. Each enclosure clip 1080 can be U-shaped, having a semi-circular curve 1084, where the distal end 915 of the enclosure clip 1080 includes an outward facing protrusion 1082. The distal end 915 of the enclosure clips 1080 may be positioned through and/or within corresponding apertures in the top plate 961 of the top plate assembly 960. In such a case, the enclosure clips 1080 are in a natural position.

The protrusions 1082 can serve as a retaining feature by sitting above, below, or within a notch in the top plate 961. To uncouple the secondary enclosure 910 from the primary enclosure 950, an inward force can be applied to the distal ends 915 of the enclosure clips 1080. When enough of an inward force is applied to the distal ends 915 of the enclosure clips 1080, the protrusions 1082 no longer contact the top plate 961. In such a case, when an upward force is additionally applied to the secondary enclosure 910, the secondary enclosure 910 can be uncoupled from the primary enclosure 950.

The secondary enclosure 910 has a passage 911 that traverses its length, having one end of the passage at the hole 916 in the top end 914 of the secondary enclosure 910. In addition, the primary enclosure 950 has a number of protruding features (e.g., fins) that extend radially from the outer sides of the enclosure wall 951.

The systems, methods, and apparatuses described herein may also provide a lower cost solution than junction box type enclosures or splice boxes used to house wire splices of lighting systems. Moreover, the secondary enclosures described herein may also allow for a reduction in the material, weight, and volume of the luminaire. In some example embodiments, the relatively small size of the secondary enclosure also allows luminaire designs for smaller or specialty housings. The manufacturing of the luminaire may also be improved by reducing the amount of fasteners used to build the luminaire, eliminating manufacturing time, and eliminating the need for tools to assemble and disassemble.

The secondary enclosures described herein may also improve safety for manufacturers as well as the installers, customers, and/or end users, as there are no sheet metal edges. Further, the secondary enclosures described herein may include features that ensure that the splice connection is fully mated (also referred to as "terminal assurance" features). Further, the example secondary enclosures ensure that the LED-based lighting system passes any applicable standards and/or regulations, such as UL standard 1598.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A light-emitting diode (LED) lighting system, comprising:

a primary enclosure comprising a secondary enclosure receiver, wherein the secondary enclosure receiver comprises a fastening feature that is positioned adjacent to an aperture in the primary enclosure; and a secondary enclosure comprising a corresponding fastening feature that mechanically couples to the fastening feature of the primary enclosure, wherein the secondary enclosure surrounds and encloses the aperture when the secondary enclosure is mechanically coupled to the primary enclosure, wherein the secondary enclosure further comprises a passage through which a wire that traverses the aperture in the primary enclosure passes.

2. The LED lighting system of claim 1, wherein the primary enclosure and the secondary enclosure each pass a flammability test set forth by Underwriter's Laboratories standard 1598.

3. The LED lighting system of claim 1, wherein the primary enclosure comprises a top plate, wherein the aperture traverses the top plate.

4. The LED lighting system of claim 1, wherein the primary enclosure is a heat sink.

5. The LED lighting system of claim 1, wherein the secondary enclosure comprises a retaining feature that interlocks with a corresponding retaining feature disposed on the secondary enclosure receiver.

6. The LED lighting system of claim 1, wherein the secondary enclosure further comprises a sealing member disposed along an inner wall of the passage and through which the wire passes.

7. The LED lighting system of claim 6, wherein the sealing member forms a seal around the wire when the secondary enclosure is mechanically coupled to the primary enclosure.

8. The LED lighting system of claim 1, wherein the corresponding fastening feature of the secondary enclosure is disposed at a bottom end of the secondary enclosure.

9. The LED lighting system of claim 1, wherein the fastening feature and the corresponding fastening feature comprise mating threads.

10. The LED lighting system of claim 9, wherein the secondary enclosure mechanically couples to the primary enclosure when the secondary enclosure is rotated less than one turn using the mating threads.

11. The LED lighting system of claim 9, wherein the secondary enclosure further comprises a retaining feature, wherein the retaining feature engages a complementary retaining feature of the secondary enclosure receiver when the secondary enclosure is mechanically coupled to the primary enclosure.

12. The LED lighting system of claim 1, further comprising:

a luminaire disconnect positioned adjacent to the aperture in the primary enclosure and into which at least one wire connects.

13. The LED lighting system of claim 12, wherein the connector traverses the aperture and is disposed, at least in part, within the passage formed within the secondary enclosure.

14. The LED lighting system of claim 1, wherein the secondary enclosure further comprises a plurality of pieces that mechanically couple to each other.

15. The LED lighting system of claim 1, further comprising:

a sealing member disposed between the primary enclosure and the secondary enclosure when the primary enclosure is mechanically coupled to the secondary enclosure.

16. The LED lighting system of claim 1, wherein the secondary enclosure is made of 5VA flame-rated plastic.

17. The LED lighting system of claim 1, wherein the secondary enclosure receiver protrudes from an outer surface of the primary enclosure.

18. The LED lighting system of claim 1, wherein the corresponding fastening feature of the secondary enclosure comprises at least one spring clip, and wherein the fastening feature of the primary enclosure comprises at least one retaining feature that receives and holds the at least one spring clip when the secondary enclosure is mechanically coupled to the primary enclosure and when the at least one spring clip is in a natural position.

19. The LED lighting system of claim 1, wherein the corresponding fastening feature of the secondary enclosure comprises at least one pair of locking tabs, and wherein the fastening feature of the primary enclosure receives and holds a portion of the secondary enclosure that protrudes from the secondary enclosure when the at least one pair of locking tabs are in a locked position.

20. The LED lighting system of claim 1, wherein the corresponding fastening feature of the secondary enclosure comprises at least one enclosure clip, and wherein the fastening feature of the primary enclosure comprises at least one receiving feature that receives and holds the at least one enclosure clip when the at least one enclosure clip is in a natural position.

* * * * *